US005429686A

United States Patent [19]

Chiu et al.

[11] Patent Number: 5,429,686

[45] Date of Patent: Jul. 4, 1995

[54] APPARATUS FOR MAKING SOFT TISSUE PRODUCTS

[75] Inventors: Kai F. Chiu; David T. Evans; Antonius F. Rietvelt, all of Brandon, Miss.; Greg A. Wendt, Neenah, Wis.

[73] Assignee: Lindsay Wire, Inc., Florence, Miss.

[21] Appl. No.: 226,735

[22] Filed: Apr. 12, 1994

[51] Int. Cl.[6] ..... D03D 23/00

[52] U.S. Cl. ..... 139/383 A; 428/225; 428/229; 428/257

[58] Field of Search ..... 139/383 A; 428/225, 428/257, 229

[56] References Cited

U.S. PATENT DOCUMENTS 3,301,746 1/1967 Sanford et al. .
3,905,863 9/1975 Ayers .
3,974,025 8/1976 Ayers .
3,994,771 11/1976 Morgan, Jr. et al. .
4,191,609 3/1980 Trokhan .
4,239,065 12/1980 Trokhan .
4,470,434 9/1984 Vuorio .
4,759,391 7/1988 Waldvogel et al. .

*Primary Examiner*—James J. Bell
*Attorney, Agent, or Firm*—Dann, Dorfman, Herrell and Skillman; Henry H. Skillman

[57] ABSTRACT

A throughdrying fabric for the drying section of a papermaking machine is disclosed in several embodiments. In each embodiment, the fabric has a load-bearing layer and a sculpture layer. The sculpture layer is characterized by impression MD knuckles, in the present instance formed as warp knuckles floating over a plurality of shutes but positioned substantially above the tops of the lowest shute knuckles in the load-bearing layer so as to provide machine direction knuckles projecting in the sculpture layer. Methods of weaving the fabric are disclosed using a standard fourdrinier loom. The loom may embody an auxiliary jacquard mechanism which is effective to control the impression warps in the sculpture level to produce a wide variety of patterns of impression knuckles which, in turn, produce an image on the pulp web which the throughdrying fabric carries through the machine.

20 Claims, 8 Drawing Sheets

APPARATUS FOR MAKING SOFT TISSUE PRODUCTS

FIELD OF THE INVENTION

The present invention relates to paper-making apparatus, and is particularly directed to an improved fabric used for transporting the web of paper pulp through selected sections of the paper-making machine.

BACKGROUND OF THE INVENTION

In the manufacture of throughdried tissue products, such as facial and bath tissue and paper towels, there is always a need to improve the properties of the final product. While improving softness always gets much attention, stretch is a property that is important in regard to the perceived durability and toughness of the product. As the stretch increases, the tissue sheet can absorb tensile stresses more readily without rupturing. Improved sheet flexibility machine direction stretch (MD stretch) at levels of about 15% are easily achieved by creping, for example, but the resulting cross-machine direction stretch (CD stretch) is generally limited to levels of about 8 percent or less due to the nature of the tissue making process.

Hence there is a need for increasing the flexibility and the CD stretch of throughdried tissue products while maintaining or improving other desirable tissue properties.

DEFINITIONS

In this application, we have used the terms "warp" and "shute" to refer to the yarns of the fabric as woven on a loom where the warp extends in the direction of travel of the fabric through the paper making apparatus (the machine direction) and the shutes extend across the width of the machine (the cross-machine direction). Those skilled in the art will recognize that it is possible to fabricate the fabric so that the warp strands extend in the cross-machine direction and the weft strands extend in the machine direction. Such fabrics may be used in accordance with the present invention by considering the weft strands as MD warps and the warp strands as CD shutes.

The warp end shute yarns may be round, flat, or ribbon-like, or a combination of these shapes. "Flat" yarns may be either rectangular or ovate, depending upon their method of manufacture and, for purposes of differentiation from "ribbon-like", are deemed to have a width to height ratio of between 1 and 2.5. "Ribbon-like" yarns have a width/height ratio of 2.5 or greater. The non-circular yarns may be either extruded or cut from flat sheets of material.

The fabric of the present invention has a load-bearing layer adjacent the machine-face of the fabric, and has a three-dimensional sculpture layer on the pulp face of the fabric. The junction between the load-bearing layer and the sculpture layer is called the "sublevel plane". The sublevel plane is defined by the tops of the lowest CD knuckles in the load-bearing layer. The sculpture on the pulp face of the fabric is effective to produce a reverse image impression on the pulp web carried by the fabric.

The highest points of the sculpture layer define a top plane. The top portion of the sculpture layer is formed by segments of "impression" warps formed into MD impression knuckles whose tops define the top plane of the sculpture layer. The rest of the sculpture layer is above the sublevel plane. The tops of the highest CD knuckles define an intermediate plane which may coincide with the sublevel plane, but more often it is slightly above the sublevel plane. The intermediate plane must be below the top plane by a finite distance which is called "the plane difference".

The porosity of the fabric determines its ability to pass air or moisture or water through the fabric to achieve the desired moisture content in the web carried by the fabric. The porosity is determined by the warp density (percent warp coverage) and the orientation and spacing of the warps and shutes in the fabric. The "warp density" is defined as the total number of warps per inch of fabric width, times the diameter of the warp strands in inches, times 100.

SUMMARY OF THE INVENTION

It has now been discovered that certain throughdrying fabrics can impart significantly increased CD stretch to the resulting product, while at the same time also delivering high bulk, a fast wicking rate, and a high absorbent capacity. These fabrics are characterized by a multiplicity of "overlapping" elongated warp MD knuckles (overlapping when viewed in the cross-machine direction) which are raised above of the intermediate plane of the drying fabric. These raised knuckles impart corresponding impressions in the tissue sheet as it is dried on the fabric. The height, orientation, and arrangement of the resulting impressions in the sheet, provide bulk, cross-machine stretch increased absorbent capacity and increased wicking rates. All of these properties are desirable for products such as facial tissue, bath tissue and paper towels or the like.

Hence in one aspect, the invention resides in an improved throughdrying fabric having from about 5 to about 300 warp knuckles per square inch, more specifically from about 10 to about 150 warp knuckles per square inch, and preferably from about 10 to 50 warp knuckles per square inch, which are raised at least 30% of the impression warp diameter, for practical consideration it should be 0.005 inch above the intermediate plane of the fabric, which macroscopically rearranges the web to conform to the surface of the throughdrying fabric.

The dryer fabrics useful for purposes of this invention are characterized by a top layer dominated by high and long warp knuckles or machine-direction floats. There are no shute (cross-machine direction) knuckles in the top layer above the intermediate plane. The plane difference is from about 30 to 150 percent, preferably from about 70 to about 110 percent, of the impression warp strand diameter. Warp strand diameters can range from 0.005 to about 0.05 inch, more specifically from about 0.005 to about 0.035 inch, preferably from about 0.010 to about 0.020 inch. The length of the warp knuckles is determined by the number of shutes that the warps float over. This number may range from 2 to 15, usually from 3 to 11, and preferably from about 3 to 7 shutes. The shute count may range from 10 to 100. For example, with a shute count of 40 shutes per inch, the floats may be as short as 0.05 and as long as 0.425 inch.

These high and long impression knuckles in the sculpture layer, when combined with the underlying load-bearing layer, produces a topographical three-dimensional sculpture which has the reverse image of a stitch-and-puff quilted effect. These warp knuckles are spaced apart in the shute direction to produce a valley in the sculpture layer between the knuckles and above the sublevel plane. When the fabric is used to dry a Wet web of tissue paper, the tissue web becomes impressed with the sculpture of the fabric and exhibits a quilt-like appearance with the impressions of these high warp knuckles appearing like stitches, and the images of the valleys appearing like the puff areas. The machine direction knuckles can be arranged in a pattern, such as a diamond-like shape, or a more free-flowing motif such as a butterflies or fish that is pleasing to the eye.

From a fabric-manufacturing standpoint, it is believed that commercially available fabrics have heretofore strived for either a co-planar surface (that is the tops of the warp and shute knuckles are at the same height) or with the shute knuckles higher than the warp knuckles. In the latter case, the warps are generally straightened out and thus pulled down into the body of the fabric during the heat-setting step to enhance the resistance to elongation and to eliminate fabric wrinkling when used in high temperatures such as in the paper-drying process. As a result, the shute knuckles are popped up towards the surface of the fabric. Often, surface sanding is employed to obtain a co-planar surface. In contrast, the warp knuckles of the fabrics in this invention remain above the intermediate plane of the fabric even after heat setting due to their unique woven structure.

In the various embodiments of the fabrics made in accordance with this invention, the base fabric in the load-bearing layer can be of any mesh or weave. The impression warps forming the high top-plane floats can be a single strand, or a group of strands. The grouped strands can be of the same or different diameters to create a sculptured effect. The machine direction strands can be round or non-circular (such as oval, flat, rectangular or ribbon-like) in cross section. These warps can be made of polymeric or metallic materials or combinations of such materials. The number of warps involved in producing the high impression warp knuckles can range from about 5 to 100 per inch on the weaving loom. The number of warps in the load-bearing layer may also range from 5 to 100 per inch.

For fabrics of the present invention, the warp coverage is greater than 65% percent, preferably from about 80 to about 100 percent. The warp coverage includes both the impression warps and the load-bearing warps. With the increased warp density, each warp strand bears less load under the paper machine operating conditions. Therefore, the load-bearing warps need not be straightened out to the same degree during the fabric heat-setting step to achieve elongation and mechanical stability. This helps to maintain the crimp of the high and long impression warp knuckles.

DESCRIPTION OF THE PREFERRED EMBODIMENTS

Figure 1:
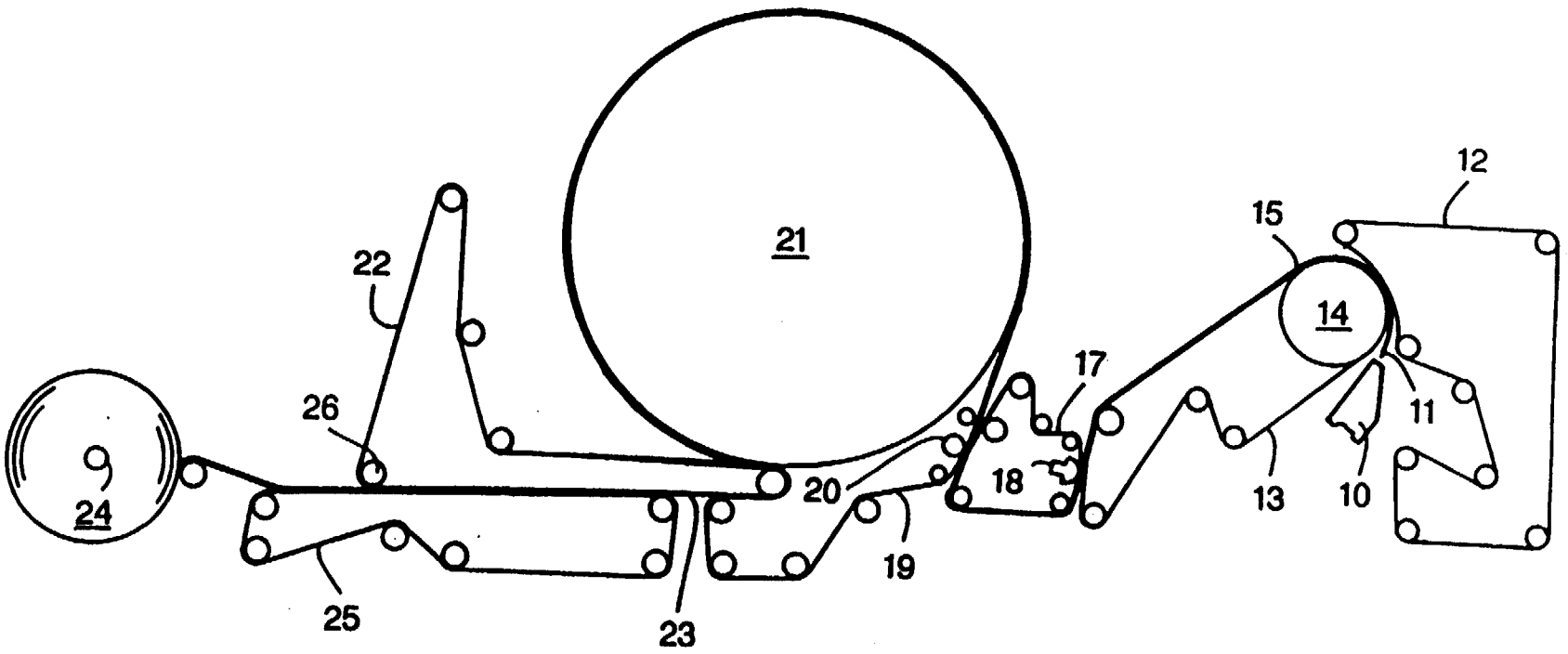
FIG. 1 is a schematic flow diagram of a paper machine embodying a fabric for making an uncreped tissue sheet in accordance with this invention.

Referring to FIG. 1, shown is a twin wire former having a layered papermaking headbox 10 which injects or deposits a stream 11 of an aqueous suspension of papermaking fibers onto the forming fabric 12. The sheet is then transferred to the fabric 13 which serves to support and carry the newly-formed wet web downstream in the process as the web is partially dewatered to a consistency of about 10 dry weight percent. Additional dewatering of the wet web can be carried out such as by vacuum suction, while the wet web is supported by the forming fabric.

The wet web is then transferred from the forming fabric to a transfer fabric 17 traveling at a slower speed than the forming fabric in order to impart increased stretch into the web. A kiss transfer is carried out to avoid compression of the wet web, preferably with the assistance of a vacuum shoe 18. The transfer fabric can be a fabric having high warp knuckles as described in connection with FIGS. 2–16 herein or it can be a fabric of a substantially co-planar top surface such as Asten 934, 937, 939 and 959 or Albany 94M. If the transfer fabric is of the high impression warp knuckle type described herein, it can be utilized to impart some of the same properties as the throughdrying fabric and can enhance the effect when coupled with a throughdrying fabric also having the high elongated impression warp knuckles. When a transfer fabric having high elongated impression warp knuckles is used to achieve the desired CD stretch properties, it provides the flexibility to optionally use a different throughdrying fabric, such as one that has a decorative weave pattern, to provide additional desirable properties not otherwise attainable.

The web is then transferred from the transfer fabric to the throughdrying fabric 19 with the aid of a vacuum transfer roll 20 or a vacuum transfer shoe. Vacuum transfer, i.e. negative pressure at one side of the web may be supplemented or replaced with positive pressure on the opposite side of the web to blow the web onto the throughdrying fabric. The throughdrying fabric can be traveling at about the same speed or a different speed relative to the transfer fabric. If desired, the throughdrying fabric can be run at a slower speed to further enhance MD stretch. Transfer is preferably carried out with vacuum assistance to ensure deformation of the sheet to conform to the throughdrying fabric, thus producing the desired bulk, flexibility, CD stretch and appearance. In accordance with the invention, the throughdrying fabric has a load-bearing layer confronting the machine, and an improved sculpture layer on the top face confronting the web, as described more fully hereinafter.

While supported by the throughdrying fabric, the web is final dried to a consistency of about 94 percent or greater by the throughdryer 21 and thereafter transferred to a carrier fabric 22. The dried basesheet 23 is transported to the reel 24 using carrier fabric 22 and an optional carrier fabric 25. An optional pressurized turning roll 26 can be used to facilitate transfer of the web from carrier fabric 22 to fabric 25. Suitable carrier fabrics for this purpose are Albany International 84M or 94M and Asten 959 or 937, all of which are substantially co-planar fabrics having a fine pattern. Although not shown, reel calendaring or subsequent off-line calendaring can be used to improve the smoothness and softness of the basesheet.

In accordance with the invention, the throughdrying fabric has top face which supports the pulp web 23, and a bottom face which confronts the throughdryer 21. Adjacent the bottom face, the fabric has a load-bearing layer which integrates the fabric while providing sufficient strength to maintain the integrity of the fabric as it travels through the throughdrying section of the paper machine, and yet is sufficiently porous to enable the throughdrying air to flow through the fabric and the pulp web carried by it. The top face of the fabric has a sculpture layer consisting predominantly of elongated warp knuckles which project substantially above the intermediate plane and the sublevel plane. The impression warp knuckles are formed by exposed segments of an impression yarn which span in the machine direction along the top face of the fabric, and are interlocked within the load-bearing layer at their opposite ends. The warp knuckles are spaced-apart transversely of the fabric, so that the sculpture layer exhibits valleys between the impression yarn segments and above the sublevel plane between the respective layers.

Figure 2:
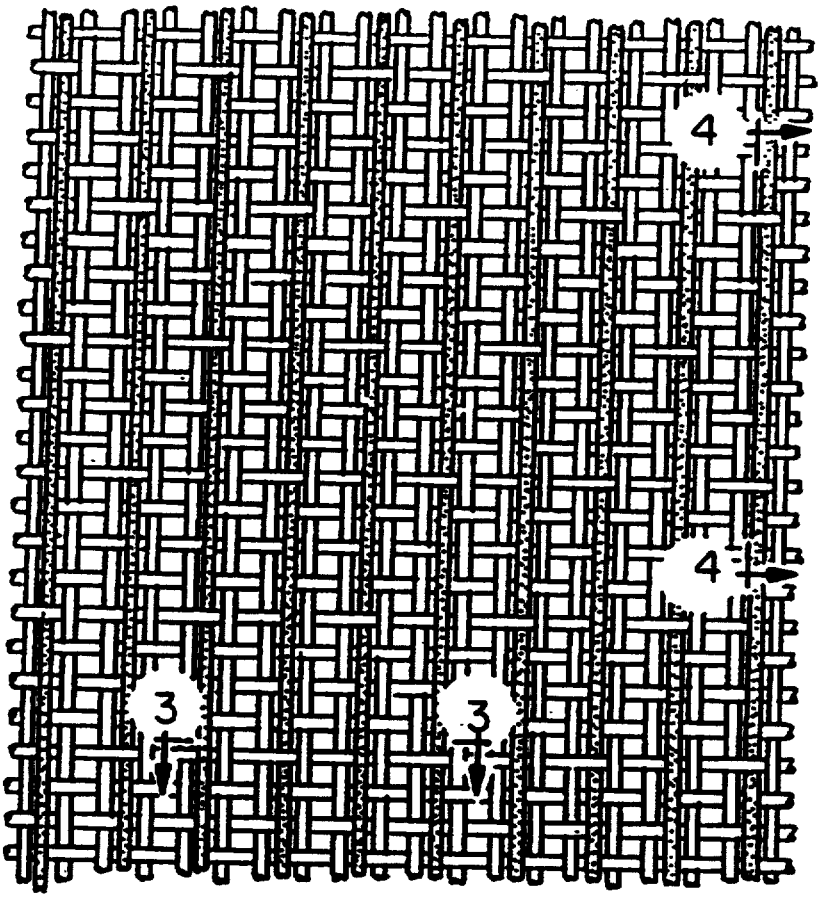
FIG. 2 is a plan view of a throughdrying fabric made in accordance with this invention.
Figure 4:
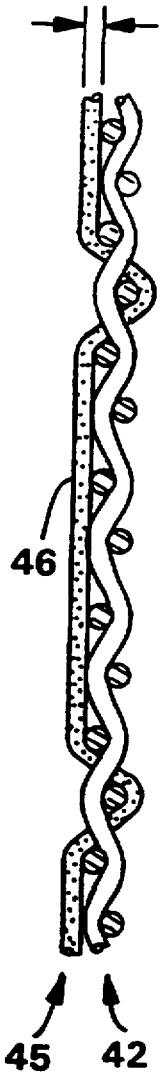
FIG. 4 is a longitudinal sectional view taken along the line 4—4 of the fabric shown in FIG. 2.
Figure 3:
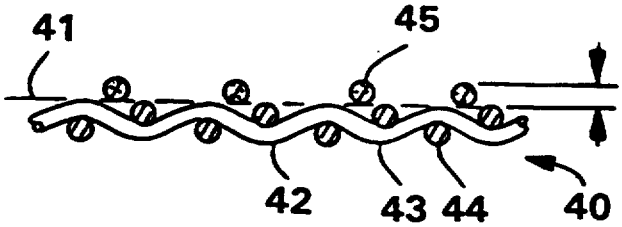
FIG. 3 is a transverse sectional view taken along the line 3—3 of the fabric shown in FIG. 2.

FIGS. 2–4 illustrate a first embodiment of a throughdrying fabric made in accordance with this invention in which high impression warp knuckles are obtained by adding an extra warp system onto a simple $1\times1$ base design. The extra warp system can be "embroidered" onto any base fabric structure. The base structure becomes the load-bearing layer and at the sublevel plane, it serves to delimit the sculpture layer. The simplest form of the base fabric would be a plain $1\times1$ weave. Of course, any other single, double, triple or multi-layer structures can also be used as the base.

Referring to these figures, the throughdrying fabric is identified by the reference character 40. Below a sublevel plane indicated by the broken line 41, the fabric 40 comprises a load-bearing layer 42 which consists of a plain-woven fabric structure having load-bearing warp yarns 44 interwoven with shute yarns 43 in a $1\times1$ plain weave. Above the sublevel plane 41, a sculpture layer indicated generally by the reference character 45 is formed by impression strand segments 46 which are embroidered into the plain weave of the load-bearing layer 42. In the present instance, each impression segment 46 is formed from a single warp in an extra warp system which is manipulated so as to be embroidered into the load-bearing layer. The knuckles 46 provided by each warp yarn of the extra warp system are aligned in the machine direction in a close sequence, and the warp yarns of the system are spaced apart across the width of the fabric 40 as shown in FIG. 2. The extra warp system produces a topographical three-dimensional sculpture layer consisting essentially of machine-direction direction knuckles and the top surface of the load-bearing layer at the sublevel plane 41. In this fabric structure, the intermediate plane is coincident with the sublevel plane. The relationship between the warp knuckles 46 and the fabric structure of the load-bearing layer 42 produces a plane difference in the range of 30–150% of the impression strand diameter, and preferably from about 70–110% of the strand diameter. In the illustration of FIG. 3, the plane difference is about 90% of the diameter of the strand 46. As noted above, warp strand diameters can range from 0.005 to about 0.05". For example, if the warp strand diameter is 0.012", the plane difference may be 0.010". For non-circular yarns, the strand diameter is deemed to be the vertical dimension of the strand, as it is oriented in the fabric, the strand normally being oriented with its widest dimension parallel to the sublevel plane.

In the fabric 40, the plain-weave load-bearing layer is constructed so that the highest points of both the load-bearing shutes and the load-bearing warps 42 and 43 are coplanar and coincident with the sublevel plane 41 and the yarns of the extra warp system 46 are positioned between the warps 44 of the load-bearing layer.

Figure 5:
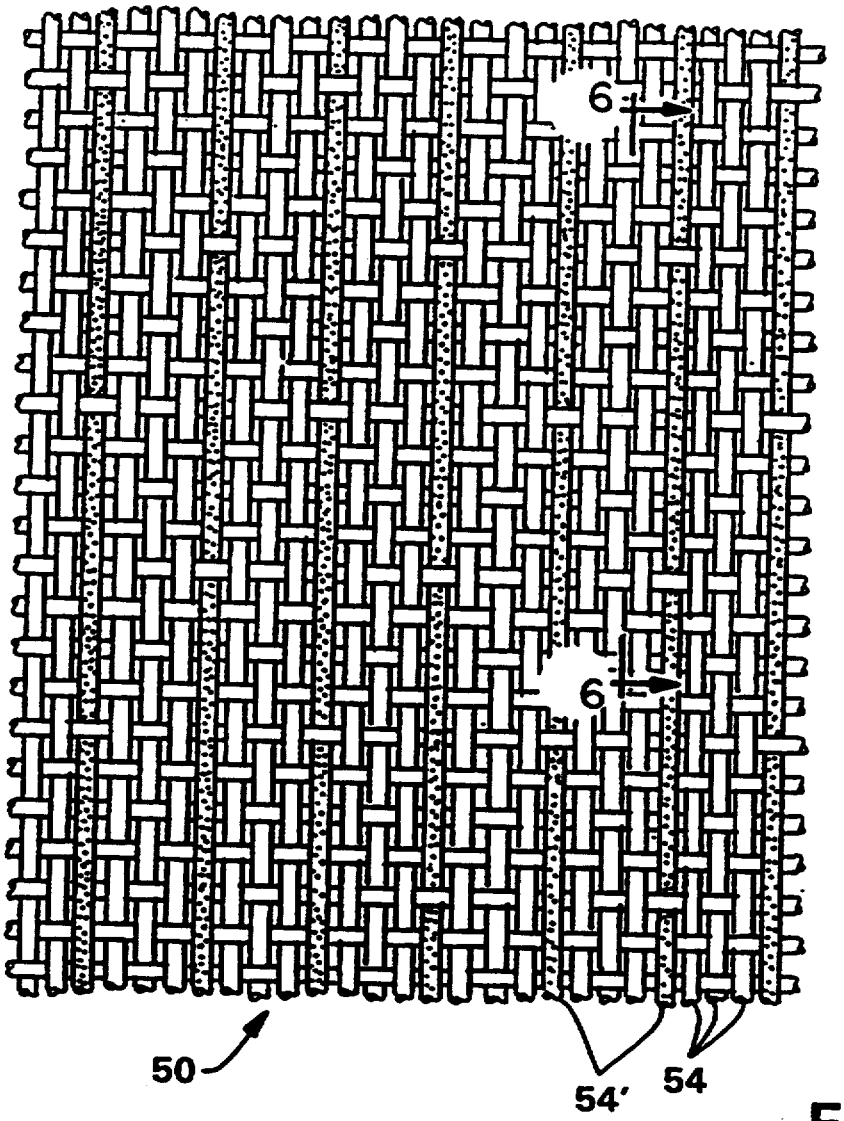
FIG. 5 is a plan view of another fabric made in accordance with this invention.
Figure 6:
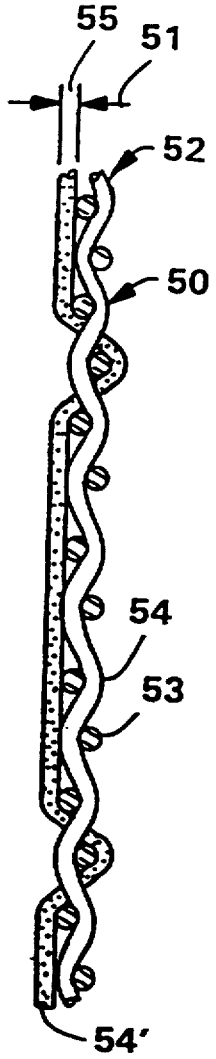
FIG. 6 is a longitudinal sectional view of the fabric shown in FIG. 5.

FIGS. 5 and 6 illustrate a modification of the fabric 40 within the scope of the present invention. The modified fabric 50 has a sublevel plane indicated by the broken line 51 with a load-bearing layer 52 below the plane 51 and a sculpture layer 55 above the plane 51. In this embodiment of the throughdrying fabric, the sculpture layer 55 has a three-dimensional pattern quite similar to the pattern of the sculpture layer 45 of the previously described embodiment, consisting of a series of warp knuckles 54' arranged in the machine direction of the fabric and spaced apart in the cross direction of the fabric. In the fabric 50, the load-bearing layer is formed by shutes 53 and warps 54 interwoven in a plain weave for the most part.

In the weave of the load-bearing layer, certain shutes knuckles may project above the sublevel plane 51. The sculpture layer 55 is formed by warp yarn segments drawn from the warp yarns 54' drawn from the load-bearing layer 52. The impression yarn segments 54' in the sculpture layer 55 are selected out from the warp system including the warps 54. In the present instance, in the warp system, which includes the warps 54 and 54', the first three warps in every four are components of the load-bearing layer 52. The fourth warp, 54', however consists of floats extending in the sculpture layer in the machine direction of the fabric above the sublevel plane 51. The impression warps 54' are tied into the load-bearing layer 52 by passing under the shutes 53 in the load-bearing layer at the opposite ends of each float.

In the fabric 50, the warp strands 54' replace one of the base warps strands 54. When using this fabric as a throughdrying fabric, the uneven top surface of the load-bearing layer at the sublevel plane 51 imparts a somewhat different texture to the puff areas of the web than is produced by the sculpture layer of the fabric 40 shown in FIGS. 2–4. In both cases, the stitch appearance provided by the valleys in the warp knuckles would be substantially the same since the warp knuckles float over seven shutes and are arranged in close sequence.

Figure 7:
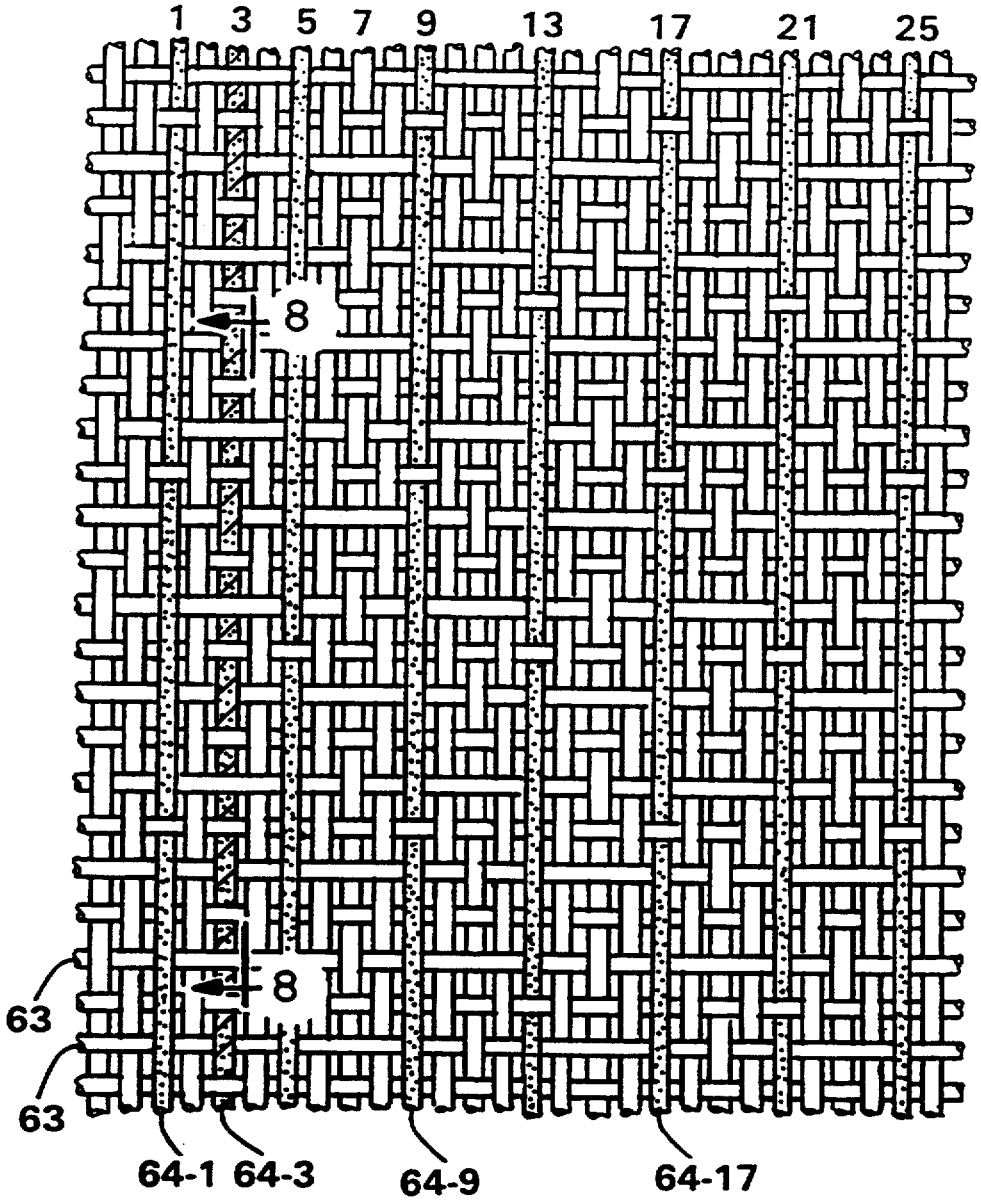
FIG. 7 is a plan view of another fabric made in accordance with this invention.
Figure 8:
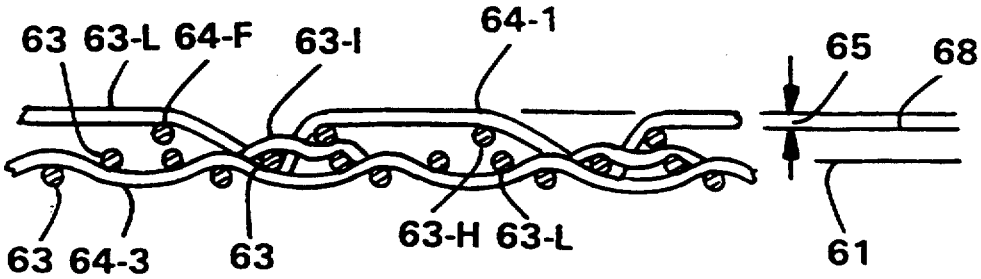
FIG. 8 is an enlarged longitudinal section of the fabric shown in FIG. 7 illustrating the positions of the top surface, the intermediate plane and the sublevel plane of the fabric.

FIGS. 7 and 8 illustrate another embodiment of the invention. In this embodiment of the invention, the throughdrying fabric 60 has a sublevel plane indicated at broken lines at 61 and an intermediate plane indicated at 68. Below the sublevel plane 61, the load-bearing layer 62 comprises a fabric woven from shute yarns 63 and warp yarns 64. The sublevel plane 61 is defined by the high points of the lowest shute knuckles in the load-bearing layer 62, as identified by the reference character 63-L. The intermediate plane 68 is defined by the high points of the highest shute knuckles, indicated by the reference character 63-H. In the drawings, the warps 64 have been numbered in sequence across the top of FIG. 7 and these numbers have been identified in FIG. 8 with the prefix 64-. As shown, the even-numbered warps follow plain weave pattern of 1×1. In the odd-numbered warps, every fourth warp, i.e. warps 1, 5 and 9, etc., are woven with a 1×7 configuration, providing warp knuckles in the sculpture layer extending over seven shutes. The remaining odd-numbered warps, i.e. 3, 7, 11, etc., are woven with a 3×1 configuration providing warp floats under 3 shutes. This weaving arrangement produces a further deviation from the coplanar arrangement of the CD and MD knuckles at the sublevel plane that is characteristic of the fabric of FIGS. 2–4 and provides a greater variation in the top surface of the load-bearing layer.

In this embodiment, tops of some of the MD and CD knuckles fall between the intermediate plane 68 and the sublevel plane 61. This weave configuration provides a less abrupt stepwise elevation of the impression warp knuckles in the sculpture layer. The plane difference in this embodiment, i.e. the distance between the highest point of the warps 64-1, 64-5, 64-9, etc. and the intermediate plane is approximately 90–110% of the thickness of the impression strand segments of these warps that form the three-dimensional effect in the sculpture layer. It is noted that with the warp patterns of FIG. 7, the shutes 63 float over a plurality of warp yarns in the cross machine direction. Such cross machine floats, however, are confined to the body below intermediate plane 68 and do not extend through the sculpture layer to reach the top face of the fabric 60. Thus, the fabric 60, like the fabrics 40 and 50, provides a weave construction without any cross-direction knuckles projecting to reach the top face of the fabric. The three-dimensional sculpture provided by the sculpture layer in each of the embodiments consists essentially of elongated and elevated impression warp knuckles disposed in a parallel array above the sublevel plane and providing valleys between the warp knuckles. In each case, the valleys extend throughout the length of the fabric in the machine direction and the floors of the valleys are delineated by the upper surface of the load-bearing layer at the sublevel plane.

Figure 17:
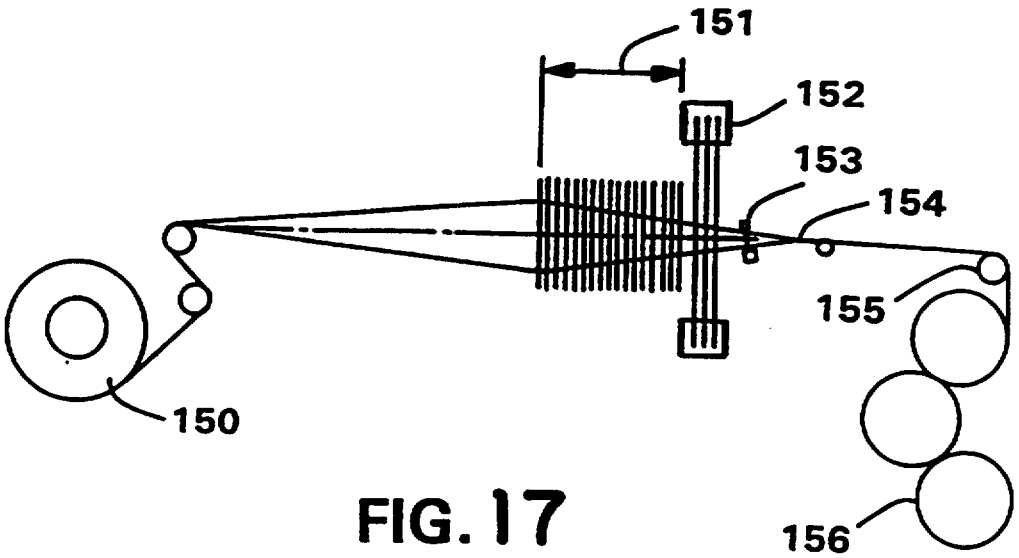
FIG. 17 is a schematic diagram of a standard fourdrinier weaving loom which has been modified to incorporate a jacquard mechanism for controlling the warps of an extra warp system to "embroider" impression warp segments into an otherwise conventional paper machine fabric.

The present invention is not limited to fabrics having a sculpture layer of this character, but complicated patterns such as Christmas trees, fish, butterflies, may be obtained by introducing a more complex arrangement for knuckles. Even more complex patterns may be achieved by the use of a jacquard mechanism in conjunction with a standard fourdrinier weaving loom, as illustrated in FIG. 17. With a jacquard mechanism controlling an extra warp system, patterns may be achieved without disturbing the integrity of the fabric which is obtained by the load-bearing layer. Even without a supplemental jacquard mechanism, more complex weaving patterns can be produced in a loom with multiple heddle frames. Patterns such as diamonds, crosses or fishes may be obtained on looms having up to 24 heddle frames.

Figure 9:
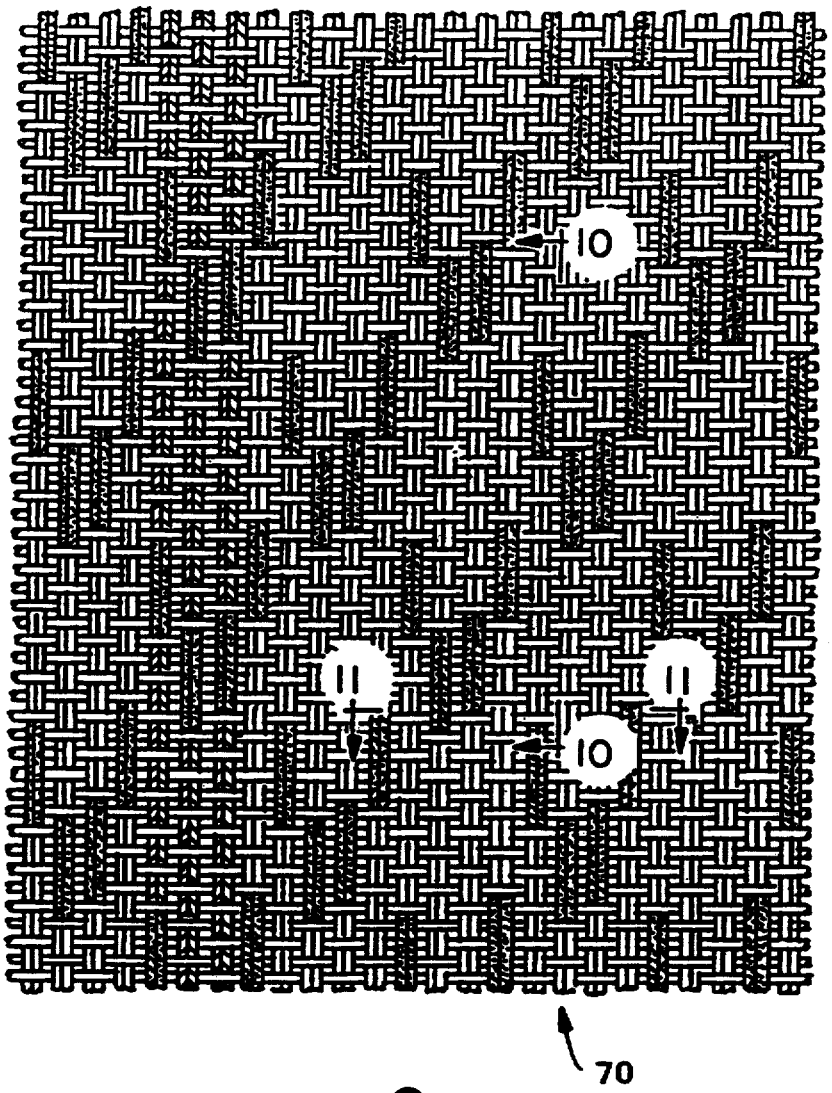
FIG. 9 is a plan view of another fabric made in accordance with this invention.
Figure 10:
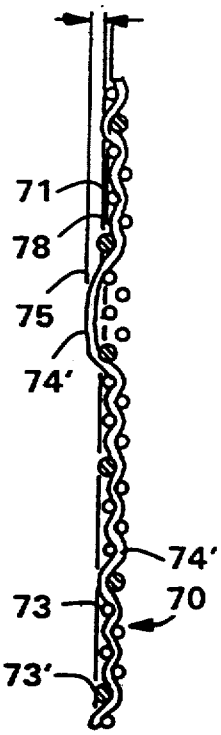
FIG. 10 is a longitudinal sectional view of the fabric shown in FIG. 7.
Figure 11:
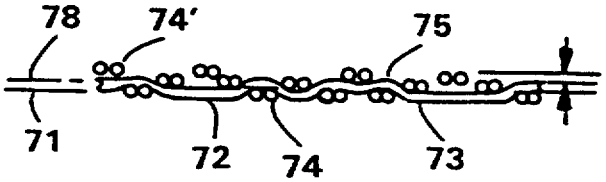
FIG. 11 is a transverse sectional view taken on the line 11—11 of the fabric shown in FIG. 9.

For example, FIGS. 9, 10 and 11 illustrate a throughdrying fabric 70 having a load-bearing layer 72 below a sublevel plane 71 and a sculpture layer 75 above that plane. In the weave construction illustrated, the warps 74 of the load-bearing layer 72 are arranged in pairs to interweave with the shutes 73. The shutes are woven with every fifth shute being of larger diameter as indicated at 73'. The weave construction of the layer 72 and its locking-in of the impression warp knuckles raises selected shute knuckles above the sublevel plane to produce an intermediate plane 78. To obtain a diamond, such as shown in FIG. 9, the pairs of warps are elevated out of the load-bearing layer 72 to float within the sculpture layer 75 as warp knuckles 74' extending in the machine direction of the fabric across the top surface of the load-bearing layer 72 at the sublevel plane 71. The warp knuckles 74' are formed by segments of the same warp yarns which are embodied in the load-bearing layer and are arranged in a substantially diagonal criss-cross pattern as shown. This pattern of warp knuckles in the top portion of the sculpture layer 75 consists essentially of warp knuckles without intrusion of any cross machine knuckles.

In the fabric 70, the warps 74 are manipulated in pairs within the same dent, but it may be desired to operate the individual warps in each pair with a different pattern to produce the desired effect. It is noted that the warp knuckles in this embodiment extend over five shutes to provide the desired diamond pattern. The length of the warp knuckles may be increased to elongate the pattern or reduced to as little as two shutes to compress the diamond pattern. The fabric designer may come up with a wide variety with interesting complex patterns by utilization of the full patterning capacity of the particular loom on which the fabric is woven.

In the illustrated embodiments, all of the warps and shutes are substantially of the same diameter and are shown as monofilaments. It is possible to substitute other strands for one or more of these elements. For example, the impression strand segments which are used to form the warp knuckles may be a group of strands of the same or of different diameters to create a sculptured affect. They may be round or non-circular, such as oval, flat, rectangular or ribbon-like in cross section. Furthermore, the strands may be made of polymeric or metallic materials or a combination of the same.

Figure 12:
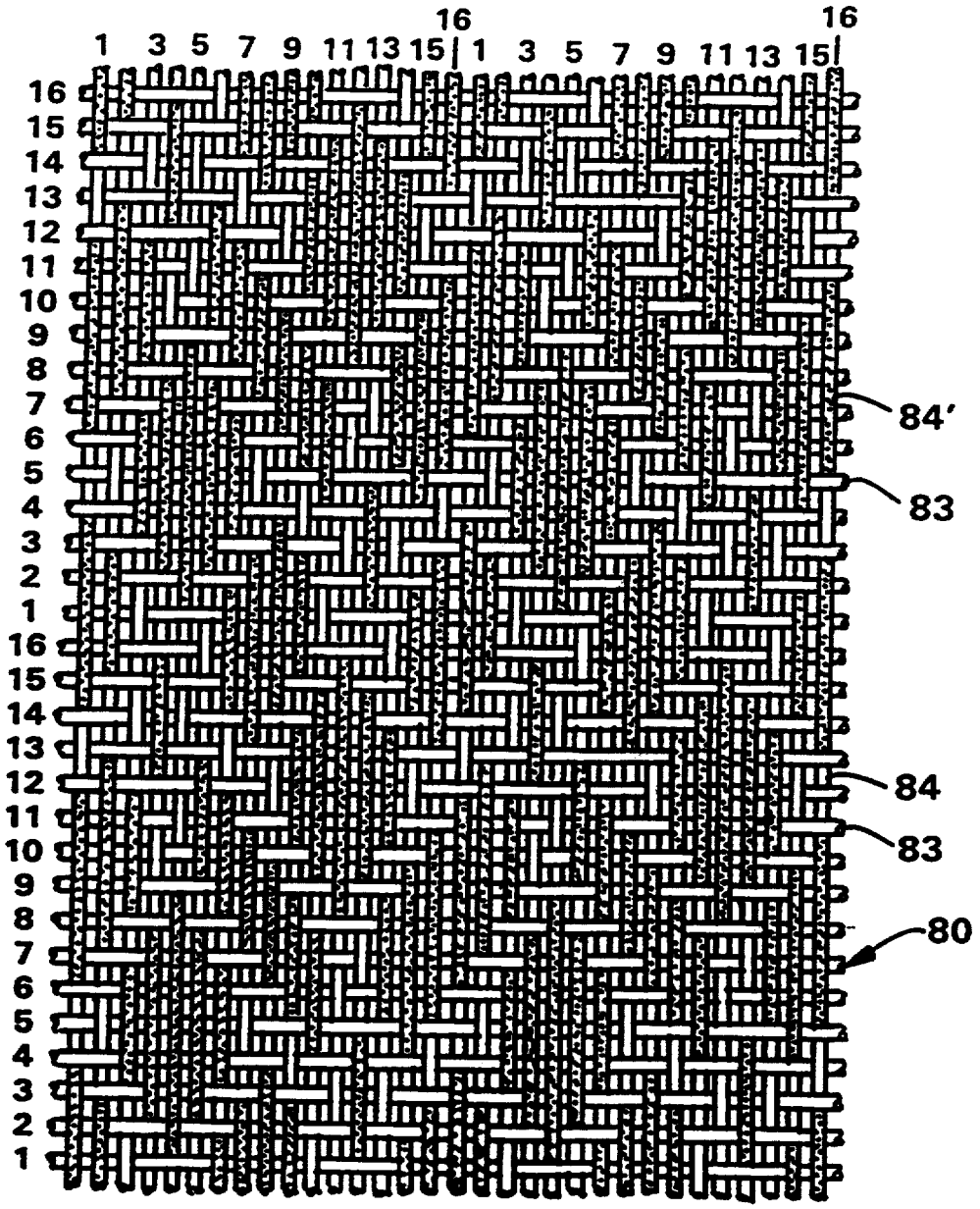
FIGS. 12 and 13 are plan views of additional fabrics embodying the invention.

FIG. 12 illustrates a throughdrying fabric 80 in which the sculpture layer provides impression warp knuckles 84' clustered in groups and forming valleys between and within the clustered groups. As shown, the warp knuckles 84' vary in length from 3–7 shutes. As in the previous embodiments, the load-bearing layer comprising shutes 83 and warps 84 is differentiated from the sculpture layer at the sublevel plane, and the tops of the shute knuckles define an intermediate plane which is below the top surface of the sculpture layer by at least 30% of the diameter of the impression strands forming the warp knuckles. In the illustrated weave, the plane is between 85% and 100% of the impression warp knuckle diameter.

Figure 13:
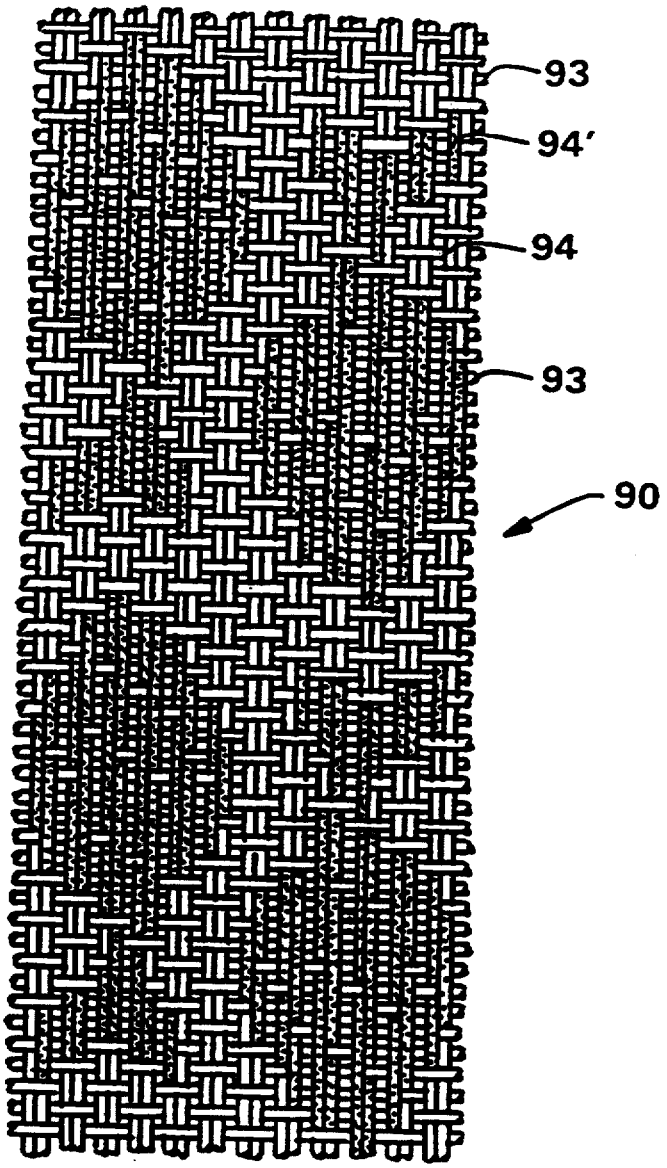

FIG. 13 illustrates a fabric 90 with impression strand segments 94' in a sculpture layer above the shutes 93 and warp 94 of the load-bearing layer. The warp knuckles 94' combine to produce a more complex pattern which simulates fishes.

Figure 14:
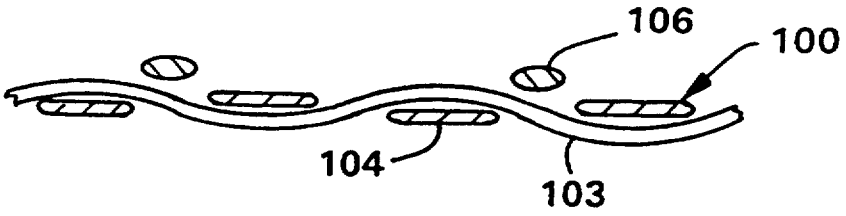
FIGS. 14–16 are transverse sectional views similar to FIG. 3 showing additional fabrics embodying non-circular warp strands made in accordance with the invention.

FIG. 14 illustrates a fabric 100 in which the impression strands 106 are flat yarns, in the present instance ovate in cross-section, and the warp yarns 104 in the load-bearing layer are ribbon-like strands. The shute yarns 103, in the present case are round The fabric 100 shown in FIG. 14 provides a throughdrying fabric having reduced thickness without sacrificing strength.

Figure 15:
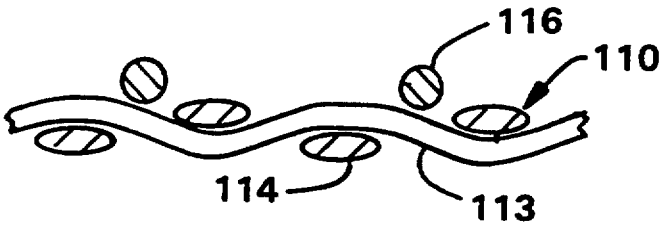

FIG. 15 illustrates a throughdrying fabric 110 in which the impression strands 116 are circular to provide a sculpture layer. In the load-bearing layer, the fabric comprises flat warps 114 interwoven with round shutes 113.

Figure 16:
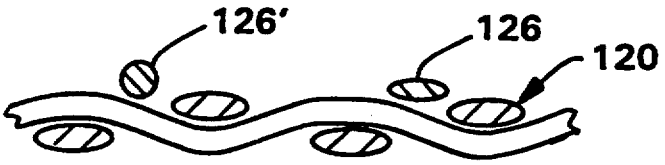

FIG. 16 illustrates a fabric 120 embodying flat warps 124 interwoven with shutes 123 in the load-bearing layer. In the sculpture layer, the warp knuckles are formed from a combination of flat warps 126 and round warps 126'.

A wide variety of different combinations may be obtained by combining flat, ribbon-like, and round yarns in the warps of the fabric, as will be evident to a skilled fabric designer.

FIG. 17 illustrates a fourdrinier loom having a jacquard mechanism for "embroidering" impression yarns into the base fabric structure to produce a sculpture layer overlying the load-bearing layer.

The figure illustrates a back beam 150 for supplying the warps from the several warp systems to the loom. Additional back beams may be employed, as is known in the art. The warps are drawn forwardly through a multiple number of heddle frames 151 which are controlled by racks, cams and/or levers to provide the desired weave patterns in the load-bearing layer of the throughdrying fabric. Forwardly of the heddle frames 151, a jacquard mechanism 152 is provided to control additional warp yarns which are not controlled by the heddles 151. The warps drawn through the jacquard heddles may be drawn off the back beam 150 or alternatively may be drawn off from a creel (not shown) at the rear of the loom. The warps are threaded through a reed 153 which is reciprocally mounted on a sley to beat-up the shutes against the fell of the fabric indicated at 154. The fabric is withdrawn over the front of the loom over the breast roll 155 to a fabric take-up roll 156. The heddles of the jacquard mechanism 152 are preferably controlled electronically to provide any desired weave pattern in the sculpture layer of the throughdrying fabric being produced. The jacquard control enables an unlimited selection of fabric patterns in the sculpture layer of the fabric. The jacquard mechanism may control the impression warps of the sculpture layer to interlock with the load-bearing layer formed by the heddles 151 in any sequence desired, or permitted by the warp-supply mechanism of the loom.

While selected embodiments of the present invention have been illustrated and described herein, it is not intended to limit the invention to such embodiments. Changes and modifications may be made within the scope of the following claims.

We claim:

1. A throughdrying fabric for use at the dry end of a paper making machine for carrying a moist web for conveyance through a throughdryer to form a basesheet, said fabric having a width corresponding to the width of the paper-making machine and a length in the form of a continuous loop corresponding to the length of the path of travel of the fabric through the throughdryer, and having a top pulp face and a bottom dryer face, said top pulp face producing a pattern on the confronting surface of the basesheet being formed from the moist web in the paper making machine by affording passage of the throughdrying air blown through said fabric and web comprising:

a load-bearing layer adjacent the dryer face having a weave comprising warp yarns interwoven with shute yarns in a weave pattern selected to produce a desired load-bearing support for the web deposited on said top pulp face, while affording passage of the throughdrying air through the fabric and the web; and impression strand segments interwoven with said load bearing layer to produce raised warp knuckles extending along the pulp face in the machine direction, said warp knuckles being spaced apart in the cross direction to produce a sculpture layer which adjoins said load-bearing layer along a sublevel plane, said sculpture layer being characterized by said warp knuckles producing valleys therebetween above said sublevel plane, said impression strand segments producing stitch-like marks, and said valleys producing puff areas in the moist web carried by the fabric.

2. A fabric according to claim 1 having a weave construction without any cross-direction knuckles projecting across the intermediate plane and reaching the top pulp face of the fabric.

3. A fabric according to claim 1 wherein said impression strand segments comprise segments of warp yarns, and the load-bearing layer comprises shute yarns interwoven with warp yarns and said impression warp yarn segments, and producing a warp density of at least 65%, the throughdrying air being angularly diverted by said warp yarns as it is blown through said base fabric.

4. A fabric according to claim 3 wherein the fabric has a warp density in the range of 70–100%.

5. A fabric according to claim 1 wherein said impression strand segments are parallel to said warp yarns, the opposite ends of said warp knuckles being interlocked within said load-bearing layer by passing under selected shute yarns.

6. A fabric according to claim 1 wherein the high points of the shute yarns facing toward the pulp face of the fabric produce an intermediate plane which is spaced below the top of the pulp face by at least 30% of the largest diameter of said impression strand segments in said warp knuckles.

7. A fabric according to claim 6 wherein said impression strand segments of said warp knuckles have at least 80% of their diameters projecting above the sublevel plane.

8. A fabric according to claim 1 wherein said impression strands comprise supplemental warp yarns embroidered into said load-bearing layer.

9. A fabric according to claim 1 wherein said load-bearing layer comprises warp yarns disposed in pairs, in selected parts of the fabric one warp yarn of each pair passing over at least three shute yarns such that said one warp yarn constitutes said impression strand segment producing a warp knuckle.

10. A fabric according to claim 1 wherein said warp knuckles of each strand segment are interlocked within said load-bearing layer at each end of the knuckle by passing under a single shute yarn, whereby said warp knuckles of each impression strand are aligned in a close sequence in the machine direction of the fabric.

11. A fabric according to claim 1 wherein said warp knuckles of each strand segment are interlocked within said load-bearing layer at each end of the knuckle by passing over and under a plurality of said shute yarns, whereby said warp knuckles are aligned in a widely-spaced sequence in the machine direction of the fabric.

12. A fabric according to claim 11 wherein the sequences of said warp knuckles in adjacent strand segments are disposed in a substantially diagonal criss-cross arrangement over the pulp face of the fabric, so as to provide a diamond pattern of valleys in said sculpture layer.

13. A fabric according to claim 1 wherein the warp knuckles in said sculpture level are clustered in groups and form valleys between and within the clustered groups.

14. A fabric according to claim 13 wherein said groups have an outline which simulates fish.

15. A fabric according to claim 1 wherein at least one of said impression strand segments, said shute yarns and said load-bearing warp yarns comprises a non-circular yarn.

16. A fabric according to claim 13 wherein said non-circular yarn is flat.

17. A fabric according to claim 13 wherein said non-circular yarn is ribbon-like.

18. A method of making a throughdrying fabric comprising the steps of weaving the fabric on a loom with warps and shutes, manipulating the warps and shutes during the weaving process to produce a load-bearing layer consisting essentially of warps and shutes and a sculpture layer consisting essentially of impression warp segments, the warp segments in said sculpture layer being anchored by shutes in the load-bearing layer, and controlling the weaving of said warps to cause said warp segments in the sculpture layer to form impression knuckles extending warpwise in the machine direction of the fabric, the tops of the impression warp knuckles defining a top plane which is elevated above the plane defined by the highest points of the shute knuckles by an amount equal to at least 30% of the diameter of the warp components forming said impression knuckles.

19. A method according to claim 18 wherein said manipulating step controls the warps in the load-bearing layer during weaving by heddle frames operated by racks, cams and/or levers.

20. A method according to claim 19 wherein said manipulating step controls at least some of the warps in the sculpture layer by jacquard heddles.

* * * * *

UNITED STATES PATENT AND TRADEMARK OFFICE

CERTIFICATE OF CORRECTION

PATENT NO. : 5,429,686

DATED : July 4, 1995

INVENTOR(S) : Chiu et al.

It is certified that error appears in the above-indentified patent and that said Letters Patent is hereby corrected as shown below:

Column 6, line 9, delete the second occurrence of "direction"

Signed and Sealed this

Thirty-first Day of October 1995

*Attest:*

*Attesting Officer*

Bruce Lehman

BRUCE LEHMAN

*Commissioner of Patents and Trademarks*